United States Patent [19]

Mori

[11] Patent Number: 4,693,036

[45] Date of Patent: Sep. 15, 1987

[54] SEMICONDUCTOR WAFER SURFACE GRINDING APPARATUS

[75] Inventor: Toshiyuki Mori, Tokyo, Japan

[73] Assignee: Disco Abrasive Systems, Ltd., Tokyo, Japan

[21] Appl. No.: 675,786

[22] Filed: Nov. 28, 1984

[30] Foreign Application Priority Data

Dec. 28, 1983 [JP] Japan ..... 58-199451[U]

[51] Int. Cl.[4] ..... B24B 7/04

[52] U.S. Cl. ..... 51/131.3; 51/235

[58] Field of Search ..... 51/131.5, 131.3, 131.4, 51/216 LP, 235

[56] References Cited

U.S. PATENT DOCUMENTS 3,809,050 5/1974 Chough et al. ..... 51/235
4,183,545 1/1980 Daly ..... 51/235
4,481,738 11/1984 Tabuchi ..... 51/131.5
4,521,995 6/1985 Sekiya ..... 51/216 LP

*Primary Examiner*—Frederick R. Schmidt
*Assistant Examiner*—Robert A. Rose
*Attorney, Agent, or Firm*—Beveridge, DeGrandi & Weilacher

[57] ABSTRACT

A grinding apparatus comprising a supporting base and at least one grinding wheel assembly disposed to face to the supporting base. The supporting base includes at least one holding table and the surface of the holding table protrudes beyond the surface of the supporting base. The grinding wheel assembly includes a rotatably mounted supporting shaft and a grinding wheel mounted to the supporting shaft. At least the surface layer of the holding table is made of $2MgO.SiO_2$-type ceramics.

3 Claims, 6 Drawing Figures

SEMICONDUCTOR WAFER SURFACE GRINDING APPARATUS

FIELD OF THE INVENTION

This invention relates to a grinding apparatus, and more specifically, to a grinding apparatus for grinding the surface of a semiconductor wafer.

DESCRIPTION OF THE PRIOR ART

As is well known, the production of semiconductor devices requires to grind the surface of a semiconductor wafer to make the thickness of the semiconductor wafer a predetermined value. As a grinding apparatus for grinding the surface of a semiconductor wafer, a grinding apparatus comprising a supporting base and at least one grinding wheel assembly disposed to face to the supporting base has been proposed and come into commercial acceptance as disclosed in European Laid-Open Patent Publication No. 0 039 209 (European Patent Application No. 81301795.1 or U.S. patent application Ser. No. 529,670) and West German Laid-Open Patent Publication No. 3120477 (U.S. patent application Ser. No. 265,318). The supporting base has at least one holding table and the surface of the holding table protrudes beyond the surface of the supporting base. The grinding wheel assembly includes a rotatably mounted supporting shaft and a grinding wheel mounted to the supporting shaft.

In the aforesaid grinding apparatus, a semiconductor wafer is placed on the surface of the holding table. The holding table is generally ventilative and the semiconductor wafer placed on the surface of the holding table is held by suction thereto by connecting the holding table to a suction source. The grinding wheel is rotated by rotating the supporting shaft and the supporting base and the grinding wheel assembly are relatively moved to cause the grinding wheel to act on the surface of the semiconductor wafer whereby the surface of the semiconductor wafer is ground.

In the aforesaid grinding apparatus, it is important that the surface of the holding table is flat enough and accurately parallel enough to the relative moving direction of the supporting base and the grinding wheel assembly in order to grind the surface of the semiconductor wafer to make the thickness of the semiconductor wafer a predetermined value accurately enough throughout its whole surface. Then, prior to the grinding of the surface of the semiconductor wafer, the surface of the holding table itself is ground to thus cause the surface of the holding table to meet the above requirements.

Therefore, it is important the make the holding table in the aforesaid grinding apparatus of a material which meets the following requirements:

(A) it can be ground well enough by means of a grinding wheel having a grinding blade which is generally made of bonded super abrasive, (B) it has a high heat resistance and a low thermal expansion coefficient since considerable heat is conducted during the grinding, and (C) it is rigid and strong enough since considerable force is applied during the grinding.

In view of the above requirements, the holding table has been made of an $Al_2O_3$-type ceramics (alumina) or a $MgO{\cdot}SiO_2$-type ceramics (steatite).

In the meantime, in the conventional grinding apparatus, it has been impossible to stably obtain a semiconductor wafer whose thickness is made a predetermined value accurately enough throughout its whole surface.

SUMMARY OF THE INVENTION

It is a primary object of this invention to provide an improved grinding apparatus which makes it possible to stably obtain a semiconductor wafer whose thickness is made a predetermined value accurately enough throughout its whole surface.

It has now been found surprisingly as a result of extensive investigations and experiments of the present inventor that if at least the surface layer of the holding table which has previously been made of an $Al_2O_3$-type ceramics or a $MgO{\cdot}SiO_2$-type ceramics is made of a $2MgO{\cdot}SiO_2$-type ceramics (forsterite), the thickness accuracy of the ground semiconductor wafer is much improved although its reason is not necessarily clear.

Accordingly to this invention, there is provided a grinding apparatus comprising a supporting base and at least one grinding wheel assembly disposed to face to said supporting base, said supporting base including at least one holding table, the surface of said holding table protruding beyond the surface of said supporting base, said grinding wheel assembly including a rotatably mounted supporting shaft and a grinding wheeel mounted to said supporting shaft, a semiconductor wafer being placed on the surface of said holding table, and said grinding wheel being caused to act on the surface of the wafer by rotating said grinding wheel by rotating said supporting shaft whereby the surface of the wafer is ground, wherein at least the surface layer of said holding table is made of a $2MgO{\cdot}SiO_2$-type ceramics.

DETAILED DESCRIPTION OF PREFERRED EMBODIMENTS

With reference to the accompanying drawings, one embodiment of the grinding apparatus improved in accordance with this invention will be described below in detail.

Figure 1:
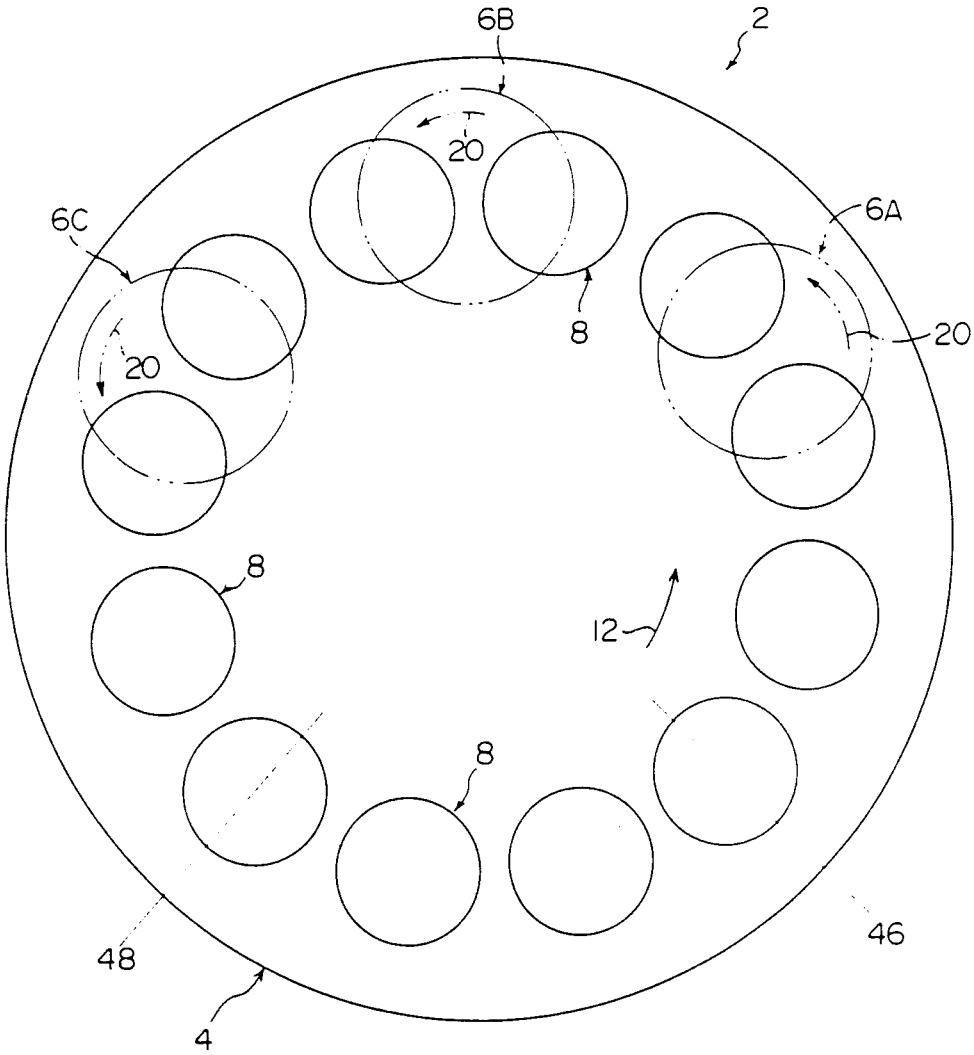
FIG. 1 is a simplified top plan view showing one embodiment of the grinding apparatus improved in accordance with this invention.
Figure 2:
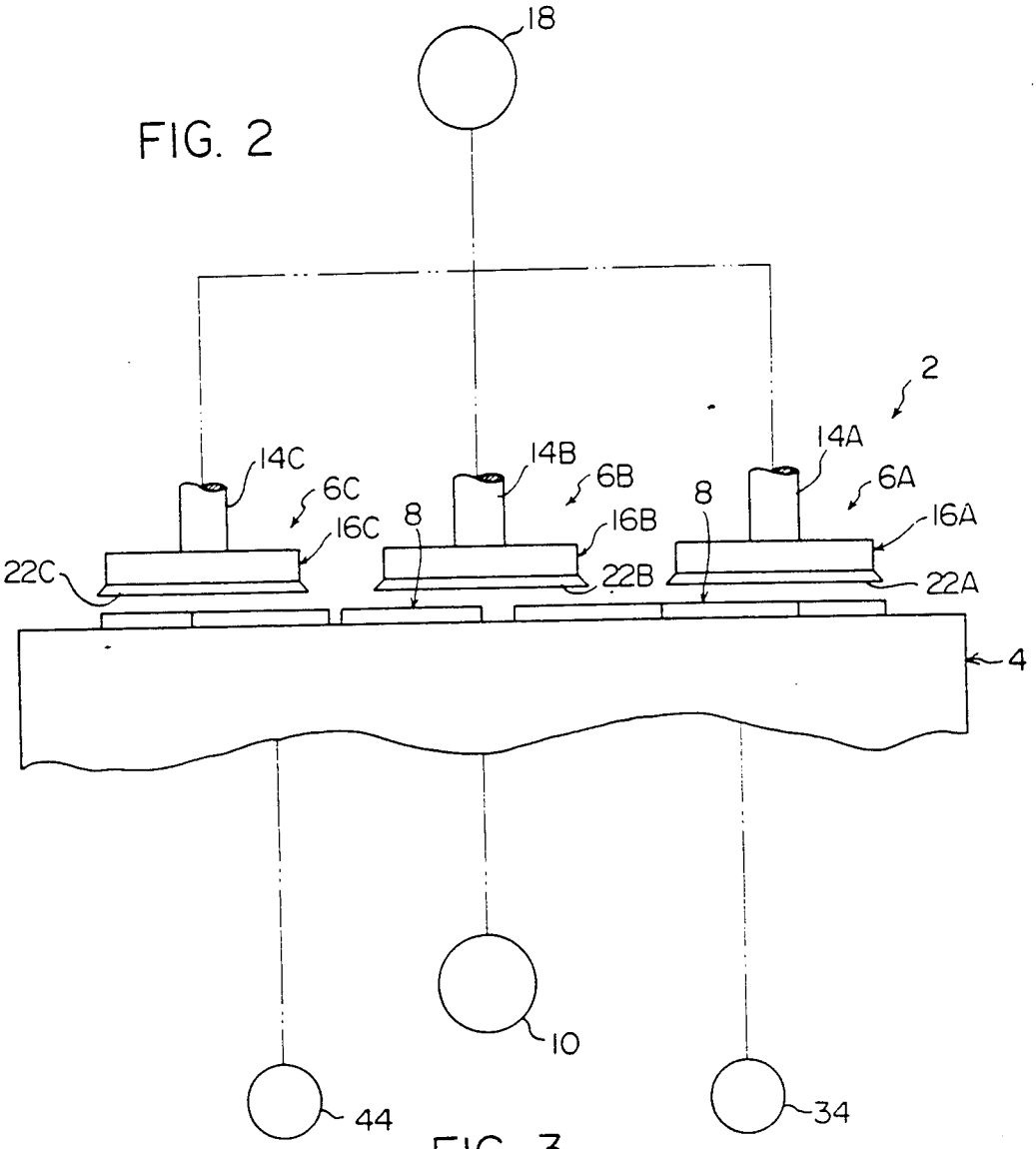
FIG. 2 is a simplified side view showing the grinding apparatus of FIG. 1.

A grinding apparatus simply shown generally at 2 in FIG. 1 and FIG. 2 is provided with a nearly disc-shaped supporting base 4 rotatably mounted about its central axis extending substantially vertically. The grinding apparatus 2 is also provided with at least one grinding wheel assembly, three grinding wheel assemblies 6A, 6B and 6C in the illustrated embodiment disposed to face to the supporting base 4 thereabove.

The supporting base 4 is provided with at least one holding table, twelve holding tables 8 circumferentially disposed at equal intervals in the illustrated embodiment. At least the surface of each of the holding tables 8 upwardly extrudes beyond the surface of the supporting base 4. The supporting base 4 is drivingly connected to a driving source 10 such as an electric motor through a suitable transmitting means (not shown) and is rotated in the direction shown by an arrow 12.

The grinding wheel assemblies 6A, 6B and 6C respectively include supporting shafts 14A, 14B and 14C mounted adjustably in their vertical positions and rotatably about their central axes extending substantially vertically and grinding wheels 16A, 16B and 16C detachably mounted to the lower ends of the supporting shafts 14A, 14B and 14C. The supporting shafts 14A, 14B and 14C are drivingly connected to a driving source 18 such as an electric motor through a suitable transmitting means (not shown) and are rotated at high speed in the directions shown by arrows 20. The grinding wheels 16A, 16B and 16C have grinding blades 22A, 22B and 22C which are formed by bonding super abrasive grains such as synthetic or natural diamond grains or cubic boron nitride grains by electrodeposition or another bonding method and are preferably annular.

Since the above-described structure of the illustrated grinding apparatus 2 does not constitute the novel features of the grinding apparatus 2 improved in accordance with this invention but only shows an example of a grinding apparatus to which this invention is applicable, a detailed description about the above-described structure of the illustrated grinding apparatus 2 is omitted in this specification.

In the grinding apparatus 2 improved in accordance with this invention, it is essential that at least the surface layer of the holding table 8 disposed to the supporting base 4 is made of a $2MgO \cdot SiO_2$-type ceramics.

Figure 3:
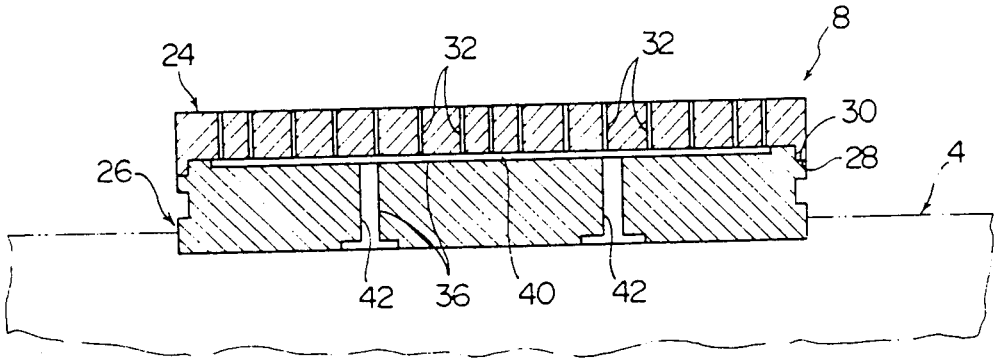
FIG. 3 is a sectional view showing a holding table used in the grinding apparatus of FIG. 1.

With reference to FIG. 3, each of the holding tables 8 in the illustrated grinding apparatus 2 is generally disc-shaped. Each of the holding tables 8 can be formed as one body, but comprises a nearly disc-shaped surface layer member 24 and a back layer member 26 fixed to the back of the surface layer member 24 in the illustrated embodiment. It is essential that the surface layer member 24 which defines the surface layer of the holding table 8 is made of a $2MgO \cdot SiO_2$-type ceramics. On the other hand, the back layer member 26 which defines the back layer of the holding table 8 is preferably made of a $2MgO \cdot SiO_2$-type ceramics but can be made of another material if desired. If the back layer member 26 is made of another material than $2MgO \cdot SiO_2$-type ceramics, it is preferably made of a material whose thermal expansion coefficient is nearly equal or close to that of $2MgO \cdot SiO_2$-type ceramics.

In the illustrated embodiment, an annular convex portion 28 is formed on the outer periphery of the back of the surface layer member 24 while a corresponding annular concave portion 30 is formed in the outer periphery of the surface of the back layer member 26, and the surface layer member 24 and the back layer member 26 are positioned to each other as required by engaging the annular convex portion 28 and the annular concave portion 30 with each other. It is preferable that the mutual contact portion of the surface layer member 24 and the back layer member 26 is heated and sintered to bond and fix the surface layer member 24 and the back layer member 26. If desired, the surface layer member 24 and the back layer member 26 can be fixed by means of another method such as adhesion instead of sintering.

Figure 4:
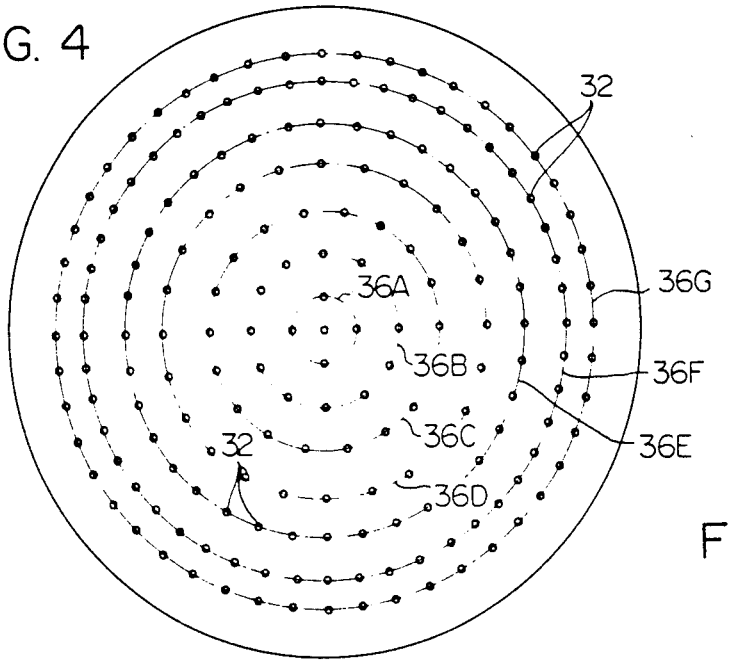
FIG. 4 is a top plan view of the surface layer member of the holding table of FIG. 3.

In the illustrated embodiment, in order to make the holding table 8 ventilative and make it possible to hold by suction a semiconductor wafer (not shown) placed on the holding table 8, the surface layer member 24 and the back layer member 26 are processed as follows. In the surface layer member 24 are formed a plurality of ventilation holes 32 substantially vertically piercing through it from its surface to its back, while in the back layer member 26 is formed a communicating means 36 for communicating the ventilation holes 32 with a suction source 34 (FIG. 2) such as a vacuum pump or an ejector. With reference to FIG. 4 as well as FIG. 3, in the surface layer member 24, one ventilation hole 32 is formed at its center and a plurality of ventilation holes 32 are formed at equal intervals along each of a plurality of (seven, in the illustrated embodiment) concentrically arranged circles 36A to 36G. On the other hand, with reference to FIG. 5 as well as FIG. 3, on the surface of the back layer member 26, a plurality of (seven, in the illustrated embodiment) concentric circular grooves 38A to 38G are formed corresponding to the circles 36A to 36G of the ventilation holes 32 in the surface layer member 24. On the surface of the back layer member 26, a plurality of (four, in the illustrated embodiment) radial grooves 40 are also formed to communicate the circular grooves 38A to 38G with one another. The radial grooves 40 are arranged at 90 degree intervals and each of them radially extends from its inner end connected to one another to its outer end connected to the outermost circular groove 38G. In the back layer member 26, at least one (four, in the illustrated embodiment) communicating holes 42 extending from its surface to its back are further formed. It is necessary to communicate one end, i.e. the upper end of each of the communicating holes 42 with the circular grooves 38A to 38G and the radial grooves 40. In the illustrated embodiment, the upper end of each of the communicating holes 42 is open to the intersection of the circular groove 38C with each of the radial grooves 40.

Each of the aforesaid holding tables 8 is mounted to a predetermined position of the supporting base 4 by means of a suitable mounting mechanism (not shown). Preferably, it is detachably mounted so that it can be replaced by another similar holding table different in size corresponding to a change in size of a semiconductor wafer (not shown) to be ground. With reference to FIG. 2 as well as FIG. 3, the other ends, i.e. the lower ends of the communicating holes 42 of each of the holding tables 8 mounted to the supporting base 4 are connected to the suction source 34 through a suitable passage means (not shown) defined in the supporting base 4. A suitable control valve (not shown) can be disposed between the communicating holes 42 of each of the holding tables 8 and the suction source 34. In the illustrated embodiment, the lower end of each of the holding tables 8 is also connected to a water source 44 through a suitable passage means (not shown) difined in the supporting base 4. A suitable control valve (not shown) can be also disposed between the communicating holes 42 of each of the holding tables 8 and the water source 44.

Next, with reference to mainly FIG. 1 and FIG. 2, the action of the grinding apparatus 2 will be briefly described.

In the grinding apparatus 2, the grinding of the surface of each of the holding tables 8 is carried our prior to the grinding of the surface of a semiconductor wafer. On this occasion, for example, a grinding wheel having a grinding blade suitable for the grinding of the surface of the holding table 8, more specifically, for the grinding of the surface of the surface layer member 24 (FIG. 3) made of a $2MgO \cdot SiO_2$-type ceramics is mounted to the supporting shaft 14A, 14B or 14C of anyone of the three grinding wheel assemblies 6A, 6B and 6C. The vertical position of the supporting shaft 14A, 14B or 14C is adjusted so that the grinding blade of the aforesaid grinding wheel is set up to interfere with the surface of each of the holding tables 8 at a predetermined grinding depth. Subsequently, the grinding wheel is rotated at high speed in the direction shown by the arrow 20 by rotating the supporting shaft 14A, 14B or 14C and the supporting base 4 is also rotated in the direction shown by the arrow 12. In this way, the surface of each of the holding tables 8 is successively ground by the grinding wheel.

After making the surface of each of the holding tables 8 flat enough and sufficiently accurately parallel to the moving direction of the supporting base 4, therefore, sufficiently accurately horizontal by grinding the surface of each of the holding tables 8 as described above, the grinding of the surface of a semiconductor wafer (not shown) is started. When grinding the surface of a semiconductor wafer, the grinding wheels 16A, 16B and 16C having the grinding blades 22A, 22B and 22C suitable for the grinding of the surface of a semiconductor wafer are respectively mounted to the supporting shafts 14A, 14B and 14C of the three grinding wheel assemblies 6A, 6B and 6C. Preferably, the grain size of the super abrasive of the grinding blade 22B is smaller than the grain size of the super abrasive of the grinding blade 22A and the grain size of the super abrasive of the grinding blade 22C is smaller than the grain size of the super abrasive of the grinding blade 22B. Therefore, the grinding roughness by the grinding blades 22A, 22B and 22C is preferably decreased in order. In the meantime, the vertical positions of the supporting shafts 14A, 14B and 14C are respectively set up as required.

Subsequently, the grinding wheels 16A, 16B and 16C are rotated at high speed in the directions shown by the arrows 20 by rotating the supporting shafts 14A, 14B and 14C and the supporting base 4 is also rotated in the direction shown by the arrow 12. At a wafer loading position shown at 46 in FIG. 1, a semiconductor wafer (not shown) is placed on the surface of the holding table 8 with its surface to be ground facing upwardly by means of a suitable loading mechanism (not shown). The holding table 8 with the semiconductor wafer placed thereon is connected to the suction source 34 and thus the semiconductor wafer is held by suction to the holding table 8. The semiconductor wafer held by suction to the holding table 8 is moved with the rotation of the supporting base 4 in the direction shown by the arrow 12, and ground on its surface to a required remaining thickness $t_1$ by receiving an action of the grinding blade 22A of the grinding wheel 16A first, further ground on its surface to a required remaining thickness $t_2$ ($t_2 < t_1$) by receiving an action of the grinding blade 22B of the grinding wheel 16B second and still further ground on its surface to a final required remaining thickness t ($t < t_2 < t_1$) by receiving an action of the grinding blade 22C of the grinding wheel 16C third. Subsequently, the holding table 8 is connected to the water source 44 and the semiconductor wafer on the holding table 8 is floated up by the water flowing out from the communicating means 36 to the surface of the holding table 8 through the communicating holes 32 (See FIG. 3 as well). At a wafer unloading position shown at 48 in FIG. 1, the ground semiconductor wafer is unloaded from the holding table 8 by means of a suitable unloading mechanism (not shown). Instead of causing all of the three grinding wheels 16A, 16B and 16C to act on the semiconductor wafer, only one or two of the grinding wheels 16A, 16B and 16C can be caused to act on the semiconductor wafer when, for example, the required grinding depth of the semiconductor wafer is relatively small.

In the aforesaid embodiment, the grinding wheels 16A, 16B and 16C are caused to act on the semiconductor wafer by moving the supporting base 4 when grinding the surface of the semiconductor wafer, but the grinding wheels 16A, 16B and 16C can be caused to act on the semiconductor wafer by moving the grinding wheel assemblies 6A, 6B and 6C instead of or in addition to moving the supporting base 4.

EXAMPLE 1

Figure 5:
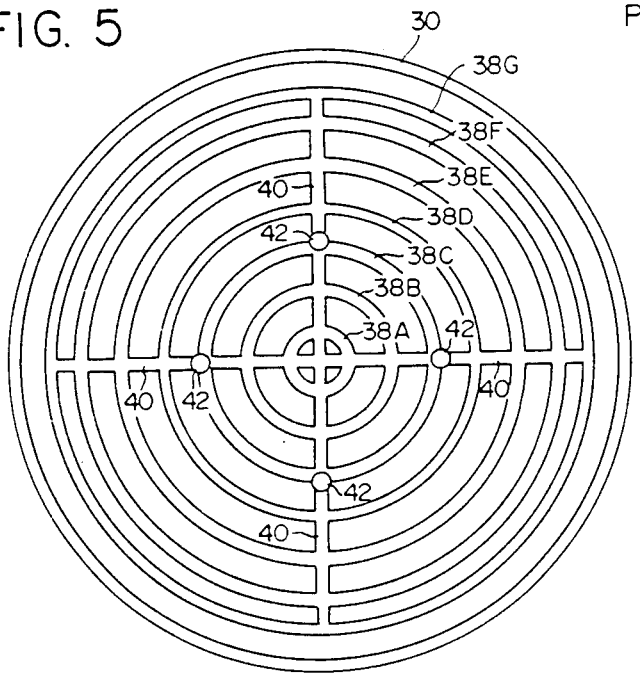
FIG. 5 is a top plan view of the back layer member of the holding table of FIG. 3.

Twelve holding tables in the shape as shown in FIG. 3 to FIG. 5 were entirely made of a $2MgO \cdot SiO_2$-type ceramics sold under a trade name of 'F-1023' by Kyocera Corporation. The twelve holding tables were mounted to a supporting base of a grinding apparatus in the shape as shown in FIG. 1 and FIG. 2 sold under a trade name of 'Rotary Surface Grinder Series 650' by Disco Abrasive Systems, Ltd.

In the first place, a grinding wheel (its grinding blade was made of synthetic diamond abrasive grains having a grain size of U.S. mesh number of 150) sold under a trade name of 'RS-02-1-SG-SS' by Disco Abrasive Systems, Ltd. was mounted to the supporting shaft of the grinding wheel assembly out of the three grinding wheel assemblies positioned at the extreme downstream side in the rotating direction of the supporting base. The surface of each of the holding tables was ground at a grinding depth of 10 μm by rotating the grinding wheel at high speed by rotating the supporting shaft and rotating the supporting base.

Subsequently, a grinding wheel (its grinding blade was made of synthetic diamond abrasive grains having a grain size of U.S. mesh number of 600) sold under a trade name of 'RS-02-1-20/30-E' by DISCO Abrasive Systems, Ltd. was mounted to the supporting shaft of the grinding wheel assembly out of the three grinding wheel assemblies positioned at the middle in the rotating direction of the supporting base and a grinding wheel (its grinding blade was made of synthetic diamond abrasive grains having a grain size of U.S. mesh number of 4000) sold under a trade name of 'RS-03-1-2/4-P' by Disco Abrasive Systems, Ltd. was mounted to the supporting shaft of the grinding wheel assembly positioned at the extreme downstream side in the rotating direction of the supporting base. Thirty-six silicon wafers (accordingly, three silicon wafers with respect to each of the twelve holding tables) were successively ground. On this occasion, a grinding depth of 83 μm was ground by the grinding wheel of the grinding wheel assembly positioned at the middle in the rotating direction of the supporting base and a grinding depth of 7 μm was ground by the grinding wheel of the grinding wheel assembly positioned at the extreme downstream side in the rotating direction of the supporting base.

Figure 6:
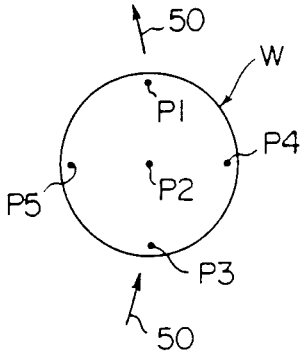
FIG. 6 is a simplified view showing thickness measurement positions of a silicon wafer in Examples 1 and 2 and Comparative Examples 1 and 2.

The thickness of the ground silicon wafer was measured at five points shown in FIG. 6, i.e., a front end position P1, a center position P2, a rear end position P3 and both side positions P4 and P5 in the moving direction of the silicon wafer W in the grinding shown by an arrow 50. The difference between the maximum and the minimum of the measured values at the five points, i.e. thickness dispersion TD was calculated in each of the thirty-six silicon wafers (for example, in the first silicon wafer, P1=443 μm, P2=444 μm, P3=443 μm, P4=443 μm and P5=444 μm. Accordingly, its thickness dispersion TD=444 μm−443 μm=1 μm). It was found that two silicon wafers had a thickness dispersion TD of 0 μm, thirty-two silicon wafers had a thickness dispersion TD of 1 μm and two silicon wafers had a thickness dispersion TD of 2 μm. Then, its average thickness dispersion ATD was $(2\times0)+(32\times1)+(2\times2)/36=1.0$ μm as shown in Table 1 below. On the other hand, out of the measured values at the five points of the thirty-six silicon wafers ($36\times5=180$ measured values), the maximum was 445 μm and the minimum was 442 μm. Then, its maximum thickness dispersion MTD was 445 μm−442 μm=3 μm as shown in Table 1 below.

EXAMPLE 2

An average thickness dispersion ATD and a maximum thickness dispersion MTD were calculated and shown in Table 1 below in the same way as in Example 1 except that holding tables were entirely made of a $2MgO{\cdot}SiO_2$-type ceramics sold under a trade name of 'F-1123' by kyocera Corporation.

COMPARATIVE EXAMPLE 1

For comparison, an average thickness dispersion ATD and a maximum thickness dispersion MTD were calculated and shown in Table 1 below in the same way as in Example 1 except that holding tables were entirely made of a $Al_2O_3$-type ceramics sold under a trade name of 'A-482R' by Kyocera Corporation.

COMPARATIVE EXAMPLE 2

Further, for comparison, an average thickness dispersion ATD and a maximum thickness dispersion MTD were calculated and shown in Table 1 below in the same way as in Example 1 except that holding tables were entirely made of a $MgO{\cdot}SiO_2$-type ceramics sold under a trade name of 'S-210' by kyocera Corporation.

TABLE 1

| | Average Thickness Dispersion ATD (μm) | Maximum Thickness Dispersion MTD (μm) |
|---|---|---|
| Example 1 | 1.0 | 3 |
| Example 2 | 1.2 | 3 |
| Comparative Example 1 | 9.3 | 18 |
| Comparative Example 2 | 5.6 | 12 |

What is claimed is:

1. A grinding apparatus comprising a supporting base and at least one grinding wheel assembly disposed to face said supporting base, said supporting base including at least one holding table, said grinding wheel assembly including a rotatably mounted supporting shaft and a grinding wheel mounted to said supporting shaft, the surface of said holding table being adapted to have a semiconductor wafer placed thereon, and said grinding wheel being adapted to act on the surface of a wafer by rotating said grinding wheel by rotating said supporting shaft whereby the surface of a wafer can be ground, said holding table is ventilative and is adapted to hold a wafer by suction to the surface of said holding table, said holding table being connected to a suction source, said holding table comprises a nearly disc-shaped surface layer member and a nearly disc-shaped back layer member fixed to the back of said surface layer member, in said surface layer member, a plurality of ventilation holes piercing through it from its surface to its back are formed at intervals, and said back layer member being provided with a communicating means for communicating said suction source with said ventilation holes of said surface layer member, said ventilation holes formed in said surface layer member being arranged along a plurality of concentrically arranged circles, said communicating means formed in said back layer member comprises a plurality of concentric circular grooves formed on the surface of said back layer member corresponding to the circles of said ventilation holes, a plurality of radial grooves formed on the surface of said back layer member for communicating said circular grooves with one another and at least one communicating hole extending from one end open to said circular grooves and/or said radial grooves to the back of said back layer member piercing through it.

2. The grinding apparatus of claim 1 wherein said communicating means includes a plurality of communicating holes open to the intersections of said circular grooves and said radial grooves at their one ends.

3. A grinding apparatus comprising a supporting base and at least one grinding wheel assembly disposed to face said supporting base, said supporting base including at least one holding table which is ventilative, the surface layer member of said holding table being nearly disc-shaped protruding beyond the surface of said supporting base and a nearly disc-shaped back layer member fixed to the back of said surface layer member, a plurality of ventilation holes piercing through said surface layer member from its surface to its back which holes are formed at intervals, and said ventilation holes formed in said surface layer member being arranged along a plurality of concentrically arranged circles, the surface of said holding table being adapted to hold a semiconductor wafer by suction to the surface of said holding table, the holding table being connected to a source of suction, said back layer member being provided with communicating means for communicating said suction source with said ventilation holes of said surface layer member, said grinding wheel assembly including a rotatably mounted supporting shaft and a grinding wheel mounted to said supporting shaft, and said grinding wheel being adapted to act on the surface of a wafer by rotating said grinding wheel by rotating said supporting shaft whereby the surface of a wafer can be ground, wherein at least the surface layer of said holding table is made of a $2MgO \cdot SiO_2$-type ceramic, said communicating means formed in said back layer member comprises a plurality of concentric circular grooves formed on the surface of said back layer member corresponding to the circles of said ventilation holes, a plurality of radial grooves formed on the surface of said back layer member for communicating said circular grooves with one another and at least one communicating hole extending from one end open to said circular grooves and/or said radial grooves to the back of said back layer member piercing through it.

* * * * *